US007927501B2

(12) United States Patent
Komuro et al.

(10) Patent No.: US 7,927,501 B2
(45) **Date of Patent: *Apr. 19, 2011**

(54) RARE EARTH ELEMENT MAGNET AND METHOD OF MANUFACTURING SAME

(75) Inventors: Matahiro Komuro, Hitachi (JP); Yuichi Satsu, Hitachi (JP); Takao Imagawa, Mito (JP); Hiroyuki Suzuki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 661 days.

This patent is subject to a terminal disclaimer.

(21) Appl. No.: 11/943,215

(22) Filed: Nov. 20, 2007

(65) Prior Publication Data

US 2008/0117008 A1 May 22, 2008

(30) Foreign Application Priority Data

Nov. 21, 2006 (JP) ..... 2006-313720

(51) Int. Cl.
*H01F 1/08* (2006.01)

(52) U.S. Cl. ..... 252/62.55; 148/302; 148/101; 148/122; 428/702; 428/323; 428/402; 428/403; 264/611; 264/612; 264/621; 264/624

(58) Field of Classification Search ..... 252/62.55; 148/302, 101, 122; 428/702, 323, 402, 403, 428/692.3; 264/611, 612, 621, 624
See application file for complete search history.

(56) References Cited

U.S. PATENT DOCUMENTS

| | | | | |
|---|---|---|---|---|
| 5,858,124 | A * | 1/1999 | Endo et al. | 148/302 |
| 6,054,219 | A * | 4/2000 | Satsu et al. | 428/403 |
| 7,147,686 | B2 * | 12/2006 | Tayu et al. | 75/244 |
| 2006/0222848 | A1 * | 10/2006 | Satsu et al. | 428/403 |

FOREIGN PATENT DOCUMENTS

| | | |
|---|---|---|
| JP | H06-69009 | 11/1994 |
| JP | 8-115809 | 5/1996 |
| JP | 10-321427 | * 5/1997 |
| JP | 10-321427 | * 12/1998 |

OTHER PUBLICATIONS

Translation for JP 10-321427.*
Official Action dated Nov. 2, 2010; Patent Application No. 2006-313720; 1 page; Japan Patent Office; Japan.

* cited by examiner

*Primary Examiner* — C. Melissa Koslow
(74) *Attorney, Agent, or Firm* — Antonelli, Terry, Stout & Kraus, LLP.

(57) ABSTRACT

A magnet comprising magnetic powder containing at least one rare earth metal element, and an oxide binder for binding the magnetic powder, wherein an inter-face distance of the binder determined by diffraction analysis is 0.25 to 2.94 nm. The disclosure also discloses a method of manufacturing a magnet comprising; compacting magnetic powder containing at least one rare earth element under pressure in a mold; impregnating the compacted magnetic powder molding with a precursor solution of an oxide material; and heat-treating the compacted magnetic molding impregnated with the precursor thereby to impart an inter-face distance determined by diffraction analysis to the binder in the compacted molding. The distance is 0.25 to 2.94 nm.

17 Claims, 3 Drawing Sheets

EQUATION 1

EQUATION 2

RARE EARTH ELEMENT MAGNET AND METHOD OF MANUFACTURING SAME

CLAIM OF PRIORITY

The present application claims priority from Japanese application serial No. 2006-313720, filed on Nov. 21, 2006, the content of which is hereby incorporated by reference into this application.

FIELD OF THE INVENTION

The present invention relates to a magnet using an oxide as a binder and a method of manufacturing the magnet.

RELATED ART

Performance of permanent magnets has been greatly improved in recent years. Magnets that have been widely used are sintered magnets in which magnetic material is sintered. Although the magnets have excellent properties, they have a problem in productivity.

Magnets in which magnetic material is bonded with resin have been investigated as well as the sintered magnets. The magnets are imparted mechanical strength by bonding the magnetic material with thermosetting epoxy resin. However, the magnets using the epoxy resin have quite bad magnetic properties at present; satisfactory magnetic properties have not obtained.

On the other hand, magnetic structures in which magnetic powder is bonded with $SiO_2$ particles are disclosed in patent document Nos. 1 and 2. In the patent document No. 1, magnets wherein rare earth magnet powder particles are bonded with $SiO_2$ and/or $Al_2O_3$ particles are disclosed; and in the patent document No. 2, inorganic bonding magnets that are filled with oxide glass material in which fine particles of an oxide magnet are dispersed are disclosed.

Patent document No. 1; Japanese patent laid-open 10-321427

Patent document No. 2; Japanese patent laid-open 8-115809.

In the conventional magnets that use the epoxy resin as the binder, in compact-molding a mixture of the magnetic material and the epoxy resin, the epoxy resin thrusts the magnetic powder away so that a density of the magnetic material is not increased sufficiently. Accordingly, it is difficult to manufacture magnets with high performance in the magnets using the epoxy resin as the binder.

$SiO_2$ as the binder disclosed in the patent document No. 1 is constituted by particles thereby to lower a filling rate of the magnet. Further, since the oxide magnetic powder that has been subjected to heat treatment at high temperatures is used, it is impossible to obtain magnets with satisfactory magnetic properties.

SUMMARY OF THE INVENTION

It is an object of the present invention to provide a magnet with improved magnetic properties and a method of manufacturing the magnet.

In order to achieve the object, the present invention provides a magnet comprising magnetic powder containing at least one rare earth metal element, and a oxide binder for binding the magnetic powder, wherein an inter-face distance determined by diffraction analysis is 0.25 to 2.94 nm.

Further, the binder in the magnet may be an amorphous material. The magnetic powder is of a ferrous magnetic material. The binder can be an oxide binder containing at least one selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$.

The magnet may have insulating films present between the magnetic powder and the oxide binder. The insulating films can have a lamellar structure of fluoride.

In addition to the above, the present invention provides a method of manufacturing a magnet comprising:

compacting magnetic powder containing at least one rare earth element, followed by molding the compacted magnetic powder;

impregnating the compacted magnetic powder molding with a precursor solution of an oxide material; and heat-treating the compacted magnetic molding impregnated with the precursor thereby to impart an inter-face distance to the binder determined by diffraction analysis, which is 0.25 to 2.94 nm.

According to embodiments of the present invention, it is possible to improve magnetic properties of magnets that use a binder for bonding the magnetic material powder. The magnet is manufactured by compacting the magnetic powder, without sintering the magnetic powder.

DETAILED DESCRIPTION OF THE PREFERRED EMBODIMENTS

In the following, a basic manufacturing process for the magnets of the present invention will be explained in detail by reference to FIG. 1.

Figure 1:
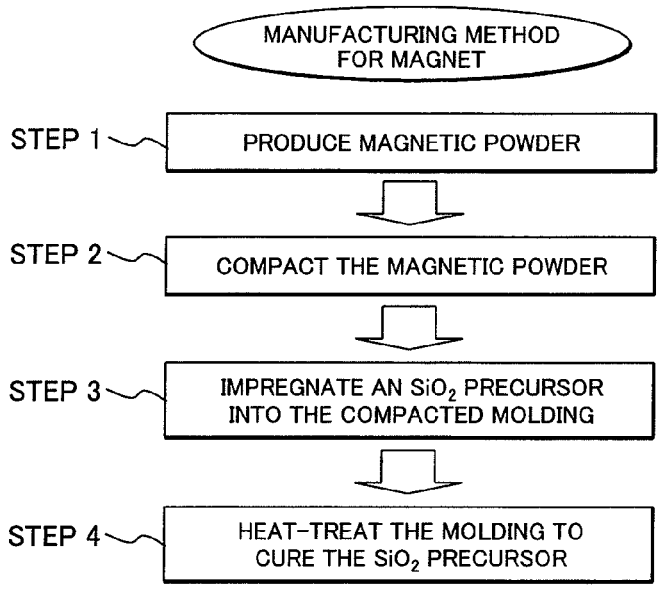
FIG. 1 is a flow chart for showing a method of manufacturing a magnet according to one embodiment of the present invention.

Rare earth element magnetic powder of NdFeB, etc is produced in the first step in FIG. 1.

The magnetic material in a powder form is compact-molded in the second step. In preparing permanent magnets for use in electric rotating machines, it is possible to shape the magnets with an ultimate desired shape by compact-molding the magnetic powder. According to the method described in detail in the following, dimensions and sizes of the compact-molded magnets hardly change in the steps after the compacted molding. Thus, it is possible to manufacture the magnets with high precision of dimension. That is, the precision required for the permanent magnet type electric rotating machines can be attained with high probability.

For example, precision required for a magnet for a magnet built-in type electric rotating machine can be achieved. On the other hand, dimensional precision of the conventional sintered magnets was very bad. Accordingly, cutting and machining work on the magnets were necessary. Therefore, productivity becomes worse and magnetic properties of the magnets may be deteriorated by cutting and machining.

A solution of a precursor of an oxide binder is impregnated into the compacted molding of the magnetic powder in the third step. The precursor is a material having good wettability with the compacted molding of the magnetic powder. Impregnation of the binder precursor solution having the good wettability with the compacted molding into the compacted molding makes the binder cover the surface of the magnetic powder that constitutes the compacted molding of the magnet, and as a result, a number of particles of the powder are bonded sufficiently. Further, the good wettability makes the solution enter the minute portions of the compacted molding of the magnet, which leads to good bonding with a reduced amount of the bonding material. Because of the good wettability, production plants for the magnets will become relatively simple and inexpensive.

At the fourth step, a magnet wherein the magnetic material is bonded by the oxide as the binder is produced by subjecting the compacted molding impregnated with the precursor to heat treatment. As described in the following, the heat treatment is carried out at 150 to 700° C. The shape and dimension of the compacted molding of the magnet hardly change during the heat treatment at the above temperatures.

In using $SiO_2$ as the binder, alcohol solvents that have chemical chains similar to an alkoxy group of alkoxysiloxane or alkoxysilane are preferable, but the solvents are not limited thereto.

For example, there are methanol, ethanol, propanol, isopropanol, etc.

As catalysts for hydrolysis and dehydration polymerization of the precursors can be any of acid catalysts, basic catalysts, and neutral catalysts. Among them, the neutral catalysts are most preferable because corrosion of metals can be minimized. As the neutral catalysts, organotin catalysts are most useful. Examples of the catalysts are bis(2-ethylhexanoate) tin, n-butyl tris(2-ethylhexanoate) tin, di-n-butyl bis (2,4-pentanedionate) tin, di-n-butyl dilauryl tin, dimethyl dineodecanoate tin, dioctyl dilaurylacid tin, dioctyl dineodecanoate tin, etc. The solvents are not limited thereto.

As the acid catalysts, dilute hydrochloric acid, dilute sulfuric acid, dilute nitric acid, formic acids, acetic acid, etc, and as the basic catalysts, sodium hydroxide, potassium hydroxide, ammonia water, etc. The acid and basic catalyst are not limited thereto.

A total amount of alkoxysiloxane or alkoxysilane and a hydrolysis product and/or dehydrated polymerization product of alkoxysiloxane or alkoxysilane as the precursor of the $SiO_2$ binder should be 5 to 96% by volume of the alcohol solution.

If the total amount of alkoxysiloxane or alkoxysilane, hydrolysis product and/or dehydrated polymerization product is less than 5 vol. %, a mechanical strength of the resulting magnet may become worse a little, because of an insufficient content of the binder in the magnet.

On the other hand, if the total amount is larger than 96 vol. %, a viscosity of the binder solution increases rapidly because of high reaction speed of alkoxysiloxane or alkoxysilane, the hydrolysis product and/or dehydrated polymerization product. This means that control of the viscosity of the solution is difficult so that such solutions will not be impregnated easily into the compacted molding.

The alkoxysiloxane or alkoxysilane and water react with each other as shown in the reaction equations 1 and 2.

In the hydrolysis reaction, an additive amount of water is one of parameters for controlling the speed of hydrolysis reaction of alkoxysiloxane or alkoxysilane of the oxides. The hydrolysis reaction is important for increasing mechanical strength of the binder in the magnet after curing the binder. If hydrolysis reaction of alkoxysiloxane or alkoxysilane takes place, the dehydration polymerization of the reaction products of the hydrolysis after the hydrolysis reaction will not proceed. The dehydration polymerization product is $SiO_2$, which has a strong bonding power to the magnetic powder and increases the bonding force of the mechanical strength of the binder.

Further, OH groups of silanol groups have strong interaction force with O (oxygen) or OH groups on the surface of the magnetic powder so as to impart strong bond thereto. However, if the hydrolysis reaction proceeds to increase a concentration of silanol groups, organic silicone compounds (hydrolysis reaction products of alkoxysiloxane or alkoxysilane containing silanol groups) react with each other to effect dehydration polymerization reaction, thereby to increase a molecular weight of the organic silicone compounds and to increase a viscosity of the binder solution. This is not a suitable for impregnation of the solution into the compacted molding.

Accordingly, an appropriate additive amount of water to the precursor alkoxysiloxane or alkoxysilane in the precursor solution should be chosen.

An additive amount of water to the precursor solution, which forms insulating films of the oxides on the particles of the magnetic powder, is preferably 1/10 to 1 a reactive equivalent in the hydrolysis reaction shown by equations 1 and 2. If the additive amount of water is less than 1/10 the reaction equivalent, many defects generate in $SiO_2$ because of a low concentration of silanol groups of the organic compound and low interaction between an organic compound having silanol groups and the surface of the particles of the magnetic powder. As a result, dehydration polymerization is hard to take place to thereby produce a product of $SiO_2$ containing a large amount of alkoxy groups, which has many defects and has low mechanical strength.

On the other hand, if an additive amount of water is larger than 1 of the reaction equivalent of hydrolysis reaction shown by the reaction equations 1 and 2, the organic compound having silanol groups easily brings about dehydration-polymerization thereby to produce a polymer with a high molecular weight. Since the resulting solution becomes viscous, this solution is not proper for use as an impregnating solution, because the solution cannot enter between particles of the magnetic powder.

As a solvent for the binding solutions, alcohols are used in general. In the solvents the alkoxy groups in the alkoxysilane exhibit a high dissociation rate so that the alcohol substitutes for the alkoxy groups. Accordingly, the solvents that have a boiling point lower than that of water and a low viscosity are preferably methanol, ethanol, n-propanol, and iso-propanol, and so on.

Though a binder solution is chemically unstable, water soluble solvents such as ketones, for example acetone, which does not increase viscosity of the solution within a short time, and have a boiling point lower than that of water, can be used as the solvent.

It is apparent from the above description that a precursor of an oxide selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$ can be applied in the same way as mentioned above. The precursors of the oxides such as alkoxysilanes or alkoxysiloxanes are preferable.

Embodiment 1

In this embodiment, magnetic powder was prepared by grinding thin strips of NdFeB group alloys, which were manufactured by quenching melt of a mother alloy of the NdFeB. NdFeB mother alloy melt was prepared by controlling its composition in a manner that Nd was added to Fe and Fe—B (ferro-boron) alloy and melted in vacuum, inert gas or reducing gas atmosphere. If desired, the mother alloy melt was injected and quenched on the surface of a rotating single roller or twin rollers in inert gas or reducing gas atmosphere, and the strip was heat treated in the inert gas or reducing gas atmosphere. The heat treatment was conducted at 200 to 700° C. This heat treatment produces fine crystal grains of $Nd_2Fe_{14}B$. The foil had a thickness of 10 to 100 nm.

When an average size of the fine crystal of $Nd_2Fe_{14}B$ is about 30 nm, an inter-grain layer has a composition of approximately $Nd_{70}Fe_{30}$. Since the thickness is smaller than a critical grain size of a single magnetic axis, a magnetic barrier is hard to be formed in the fine crystals. Because magnetization axes of fine crystals of $Nd_2Fe_{14}B$ are magnetically coupled with each other through fine crystals; it is presumed that reversal of magnetization axes is caused by propagation of magnetic barriers.

As one method of controlling the magnetization reversal, there is a method of assisting magnetic coupling among the magnetic powder particles from the ground foil. For the above purpose, it is effective to make a non-magnetic portion thin as much as possible. The ground powder was charged in a metal mold made of WC ultra hardness alloy to which Co was added, and was molded by compacting under a pressure of 5-20 t/cm$^2$ by means of an upper and lower punch.

The resulting molding had little gaps in the magnetic powder in a direction perpendicular to a pressing direction (a direction in parallel with a direction perpendicular to a thickness of the foil). This is because the magnetic powder produced by grinding the foil is of a flake form, which results in anisotropy in arrangement of powder particles of the molding. That is, a long axis of the flake powder is oriented in a direction perpendicular to the pressing direction.

As a result that the long axis of the flake powder is easily oriented to the direction perpendicular to the pressing direction, magnetization permeance of each particle of the powder in the direction perpendicular to the pressing direction is larger than that in the direction because the magnetization axes are continuous, and hence the magnetization reversal is hard to take place. This generates a large difference in demagnetization curves between the pressing direction and the direction perpendicular to the pressing direction.

In a compacted molding of 10×10×10 mm, when the demagnetization curves were measured by magnetization of the compacted molding at 20 kOe in the right angle with respect to the pressing direction, a residual magnetic flux density (Br) was 0.64 T and a coercive force (iHC) was 12.1 kOe, respectively. On the other hand, when the compacted molding was magnetized in the pressing direction at 20 kOe, the residual magnetic flux density Br was 0.60 T and coercive force iHC was 11.8 kOe in the direction of the magnetization. It is presumed that the difference in the demagnetization curves are caused by anisotropy in orientation of flake magnetic powder particles in the compacted molding.

The compacted molding of flake form powder particles were impregnated with the following precursor solutions 1) to 3) for $SiO_2$ and then heat-treated. The steps will be explained in the following.

Solutions of the following three precursors for $SiO_2$ were used.

1) 5 mL of $$CH_3O—(Si(CH_3O)_2—O)_m—CH_3 \quad \text{Formula 1}$$

(m is 3-5, an average number is 4.) was mixed with 0.96 mL of water, 95 mL of dehydrated methyl alcohol and 0.05 mL of dibutyltin (IV) dilaurate; the mixture was left for two nights and days at 25° C.

2) 25 mL of $$CH_3O—(Si(CH_3O)_2—O)_m—CH_3 \quad \text{Formula 2}$$

(m is 3-5, an average number is 4.) was mixed with 4.8 mL of water, 75 mL of dehydrated methyl alcohol and 0.05 mL of dibutyltin (IV) dilaurate; the mixture was left for two nights and days at 25° C.

3) 100 mL of $$CH_3O—(Si(CH_3O)_2—O)_m—CH_3 \quad \text{Formula 3}$$

(m is 3-5, an average number is 4.) was mixed with 3.84 mL of water, and 0.05 mL of dibutyltin (IV) dilaurate; the mixture was left for 4 hours at 25° C.

Viscosities of the 1)-3) $SiO_2$ precursor solutions were measured at 30° C. with an Ostwald viscometer.

(1) Compacted moldings for measurement of magnetic properties of the NdFeB group magnetic powder, having an vertical of 10 mm, a width of 10 mm and a thickness of 5 mm and a compacted molding for measurement of mechanical strength, having an vertical of 15 mm, a width of 10 mm and a thickness of 2 mm were prepared in the manner wherein magnetic powder of $Nd_2Fe_{14}B$ was charged in a mold and compacted under a pressure of 16 t/cm$^2$.

(2) The compacted moldings prepared in (1) were placed horizontally in vats separately and the precursor solutions 1)-3) for $SiO_2$ were charged in the vats at a rising rate of level at 1 mm/min. The level of the precursor solutions was 5 mm above the top faces of the compacted moldings.

(3) The vats where the compacted moldings used in the step (2) above were placed were set in a vacuum chamber, and the vacuum chamber was evacuated gradually to about 80 Pa. The compacted moldings were left until bubbles from the surface of the compacted moldings were not observed.

(4) The inner pressure of the evacuated vats where the compacted moldings and the precursor solutions were placed was gradually recovered to the atmospheric pressure. The compacted moldings were taken out from the precursor solutions in the vats.

(5) The compacted moldings impregnated with the precursor solutions for $SiO_2$ prepared in the (4) step were set in a vacuum dryer and were subjected to vacuum heat treatment under a pressure of 1-3 Pa at a temperature of 150 to 300° C.

(6) The compacted molding that has been subjected to measurement of specific resistance was subjected to investigation of magnetic properties by applying a pulse magnetic field of 30 kOe.

Among magnetic properties of the molding compacted moldings of the vertical of 10 mm, the width of 10 mm and the thickness of 5 mm, prepared in the step (5), the residual magnetic flux density was 20 to 30% higher than that of the resin bonded magnet, and the demagnetization curve obtained at 20° C. showed that the residual magnetic flux density and coercive force of the moldings before the $SiO_2$ precursor impregnation and after the $SiO_2$ precursor impregnation plus heat treatment were approximately same.

A thermal demagnetization rate after maintaining at 200° C. for one hour was 3.0% in case of $SiO_2$ impregnated bonding magnet, which is smaller than that (5%) of a magnet without $SiO_2$ impregnation. A irreversible thermal demagnetization rate in re-magnetization after returning the $SiO_2$ bonding magnet, which was maintained at 200° C. for one hour, to room temperature was less than 1%, while the irreversible thermal demagnetization rate in the epoxy resin bonding magnet was approximately 3%. Because the surface of the magnet powder, which includes cracks, is protected by impregnated $SiO_2$ in the $SiO_2$ bonding magnet, corrosion such as oxidation is suppressed to thereby reduce the irreversible thermal demagnetization rate.

That is, the powder particle surface including cracks is protected by impregnating treatment with the $SiO_2$ precursor to suppress corrosion of the magnetic powder particles the thereby reduce the irreversible thermal demagnetization rate. Not only the irreversible thermal demagnetization rate, but also demagnetization of the impregnated magnet by PCT test and salt spraying test was smaller than that of the without impregnation magnet.

The compacted molding prepared in the step (5) was subjected to demagnetization curve measurement at 20° C. after cooling it at 225° C. for one hour in air. The direction of magnetic field for application was 10 mm, wherein magnetization was conducted in a magnetic field of +20 Oe, then alternating magnetic field of ±1 kOe to ±10 kOe was applied to measure the demagnetization curve.

Figure 3:
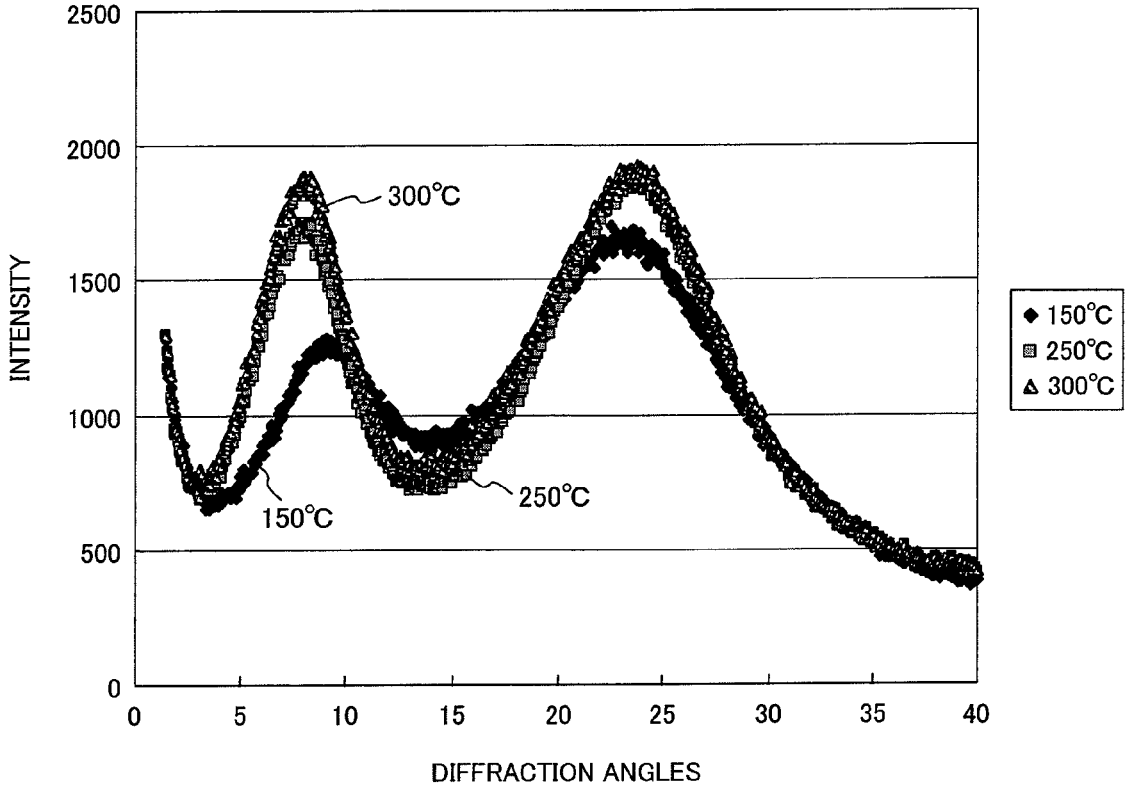
FIG. 3 is a flow chart for showing still another method for manufacturing a magnet according to one embodiment of the present invention.
Figure 4:
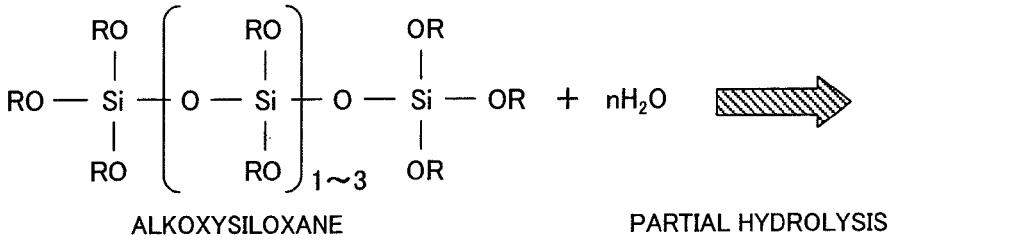
FIG. 4 shows a hydrolysis reaction of a precursor of a binder.
Figure 4:
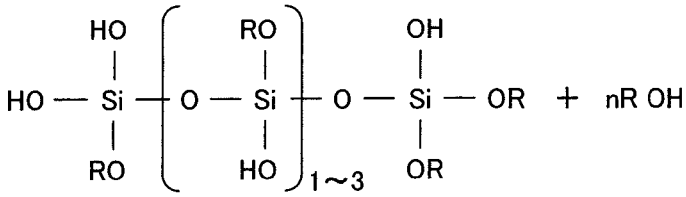
Figure 5:
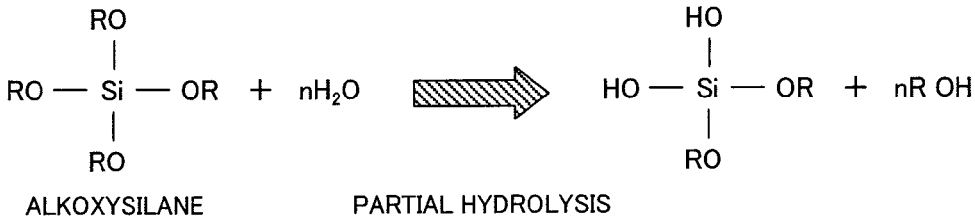
FIG. 5 is another hydrolysis reaction of another precursor of another binder.

The bonding agent used for the compacted molding in (5) was evaluated by X ray diffraction to obtain the diffraction patters shown in FIG. 3. In FIG. 3, the abscissa represents diffraction angle (0) and the ordinate represents magnetic strength; the vacuum heat treatment in (5) was conducted at 150° C., 250° C. and 300° C., respectively.

It will be understood from the diffraction patterns shown in FIG. 3 that since the patterns are broad or haloed patterns, the binder has an amorphous structure. Each of the patterns consists of two broad peaks, and it is understood that amorphous structures each having a different average inter-atomic distance are formed. The positions of broad peaks may change in accordance with heat treatment temperature, and it is recognized that the inter-atomic distance or inter-face distance may change.

The inter-face distance (average value d) of the binder (regularly cyclic distance of the binder) is calculated by Bragg's equation ($\lambda=2d_{sin}\ \Theta$) from the diffraction angle calculated by the center of integral of the X ray diffraction peaks.

In FIG. 3, if a width of the diffraction angle (2Θ) is set to 3 to 36°, the inter-face distance (d) of the $SiO_2$ group is calculated as 0.25 to 2.94 nm by the Bragg's equation. If the distance (d) is larger than 2.94 nm, bonding force by the oxide deteriorates, and the mechanical strength of the molding becomes less than 50 MPa. As a result, the molding can not be used. On the other hand, if the distance is less than 0.25 nm, diffraction peaks in addition to the broad peaks are observed at a higher angle side so that magnetic properties become worse. Accordingly, the inter-face distance in case of the $SiO_2$ bonding agent should preferably be 0.25 to 2.94 nm.

Embodiment 2

In this embodiment, the rare earth element magnetic powder was the NdFeB group powder prepared by crushing the foil the same as that in Embodiment 1.

The following three kinds of $SiO_2$ precursor as the binder were used.

1) 25 mL of $CH_3O—(Si(CH_3O)_2—O)_m—CH_3$ (m is 3-5, an average number is 4.) was mixed with 0.96 mL of water, 75 mL of dehydrated methyl alcohol and 0.05 mL of dibutyltin (IV) dilaurate; the mixture was left for two nights and days at 25° C.

2) 25 mL of $CH_3O—(Si(CH_3O)_2—O)_m—CH_3$ (m is 3-5, an average number is 4.) was mixed with 4.8 mL of water, 75 mL of dehydrated methyl alcohol and 0.05 mL of dibutyltin (IV) dilaurate; the mixture was left for two nights and days at 25° C.

3) 100 mL of $CH_3O—(Si(CH_3O)_2—O)_m—CH_3$ (m is 3-5, an average number is 4.) was mixed with 9.6 mL of water, 75 mL of dehydrated methyl alcohol, and 0.05 mL of dibutyltin (IV) dilaurate; the mixture was left for 4 two night and two days at 25° C.

Viscosities of the 1)-3) $SiO_2$ precursor solutions were measured at 30° C. with an Ostwald viscometer.

(1) Compacted moldings for measurement of magnetic properties of magnetic properties of the NdFeB group magnetic powder, having an vertical of 10 mm, a width of 10 mm and a thickness of 5 mm and a compacted molding for measurement of mechanical strength, having an vertical of 15 mm, a width of 10 mm and a thickness of 2 mm were prepared in the manner wherein magnetic powder of $Nd_2Fe_{14}B$ was charged in a mold and compacted under a pressure of 16 $t/cm^2$.

(2) The compacted moldings prepared in (1) were placed horizontally in vats separately and the precursor solutions 1)-3) for $SiO_2$ were charged in the vats at a rising rate of level at 1 mm/min. The level of the precursor solutions was 5 mm above the top faces of the compacted moldings.

(3) The vats where the compacted moldings used in the step (2) above were placed were set in a vacuum chamber, and the vacuum chamber was evacuated gradually to about 80 Pa. The compacted moldings were left until bubbles from the surface of the compacted moldings were not observed.

(4) The inner pressure of the evacuated vats where the compacted moldings and the precursor solutions were placed was gradually recovered to the atmospheric pressure. The compacted moldings were taken out from the precursor solutions in the vats.

(5) The compacted moldings impregnated with the precursor solutions for $SiO_2$ prepared in the (4) step were set in a vacuum dryer and were subjected to vacuum heat treatment under a pressure of 1-3 Pa at a temperature of 200 to 300° C.

(6) The compacted molding prepared in the step (5), having 10×10×10 mm molding was subjected to measurement of specific resistance by four needle probe method.

(7) The compacted molding that has been subjected to measurement of the specific resistance was subjected to measurement of magnetic properties by applying a pulse magnetic field of 30 Oe.

A bending strength of the molding prepared in (1), having a vertical of 15 mm, width of 10 mm and thickness of 2 mm, was 2 MPa or less before impregnation of the $SiO_2$ precursor, but the bending strength of the molding after impregnation was 70 MPa or more. When the precursor solutions 2) and 3) were used, the bending strength was 100 MPa or higher.

When the binder of the above magnet moldings was evaluated by X ray diffraction analysis, the resulting diffraction patterns were broad or harrow patterns, which indicate the binder was an amorphous oxide. The inter-face distance determined from the patterns was 1.5 nm. If the molding was heated at a temperature higher than 800° C., peaks were observed at a higher angle side. It has been confirmed that the magnetic powder and the amorphous oxide reacted each other.

The diffraction peaks with a diffraction angle (2θ) of 40 degrees or more indicate that the rare earth element oxide on the magnetic powder reacts with the amorphous oxide to form a composite oxide and diffusion of the rare earth element in the magnetic powder takes place simultaneously. As a result, reaction between the rare earth element and oxygen at grain boundaries in the magnetic powder takes place to deteriorate magnetic properties thereof. If the inter-face distance of the $SiO_2$ group oxide is kept at 0.25 to 2.94 nm, the magnetic properties are maintained and a compression strength of 50 MPa or more is maintained. Accordingly, $SiO_2$ group bonding agents should preferably have the inter-face distance of 0.25 to 2.94 nm.

Embodiment 3

In this embodiment, the rare earth element magnetic powder was the NdFeB group powder prepared by crushing the foil as same as that in Embodiment 1.

The following three kinds of $SiO_2$ precursor as the binder were used.

1) 25 mL of $CH_3O—(Si(CH_3O)_2—O)_m—CH_3$ (m is 3-5, an average number is 4.) was mixed with 5.9 mL of water, 75 mL of dehydrated methyl alcohol and 0.05 mL of dibutyltin (IV) dilaurate; the mixture was left for two nights and days at 25° C.

2) 25 mL of $CH_3O—(Si(CH_3O)_2—O)_m—CH_3$ (m is 3-5, an average number is 4.) was mixed with 4.8 mL of water, 75 mL of dehydrated methyl alcohol and 0.05 mL of dibutyltin (IV) dilaurate; the mixture was left for two nights and days at 25° C.

3) 25 mL of $CH_3O—(Si(CH_3O)_2—O)_m—CH_3$ (m is 6-8, an average number is 7.) was mixed with 4.6 mL of water, 75 mL of dehydrated methyl alcohol, and 0.05 mL of dibutyltin (IV) dilaurate; the mixture was left for 4 two night and two days at 25° C.

Viscosities of the 1)-3) $SiO_2$ precursor solutions were measured at 30° C. with an Ostwald viscometer.

(1) Compacted moldings for measurement of magnetic properties of magnetic properties of the NdFeB group magnetic powder, having an vertical of 10 mm, a width of 10 mm and a thickness of 5 mm and a compacted molding for measurement of mechanical strength, having an vertical of 15 mm, a width of 10 mm and a thickness of 2 mm were prepared in the manner wherein magnetic powder of $Nd_2Fe_{14}B$ was charged in a mold and compacted under a pressure of 16 t/cm$^2$.

(2) The compacted moldings prepared in (1) were placed horizontally in vats separately and the precursor solutions 1)-3) for $SiO_2$ binder were charged in the vats at a rising rate of level at 1 mm/min. The level of the precursor solutions was 5 mm above the top faces of the compacted moldings.

(3) The vats where the compacted moldings used in the step (2) above were placed were set in a vacuum chamber, and the vacuum chamber was evacuated gradually to about 80 Pa. The compacted moldings were left until bubbles from the surface of the compacted moldings were not observed.

(4) The inner pressure of the evacuated vats where the compacted moldings and the precursor solutions were placed was gradually recovered to the atmospheric pressure. The compacted moldings were taken out from the precursor solutions in the vats.

(5) The compacted moldings impregnated with the precursor solutions for $SiO_2$ prepared in the (4) step were set in a vacuum dryer and were subjected to vacuum heat treatment under a pressure of 1-3 Pa at a temperature of 200 to 300° C.

(6) The compacted molding that has been subjected to measurement of the specific resistance was subjected to measurement of magnetic properties by applying a pulse magnetic field of 30 Oe.

As oxides whose precursors are capable of being impregnated or injected into the molding, there are AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$. The oxides can be used singly or in combination.

The oxides are amorphous; the precursors of the oxides are capable of being impregnated along the surface of the magnetic powder. The oxide is coated on the surface of fine cracks.

The oxide is formed by impregnating the precursor into a pre-molding of the magnetic powder including cracks caused by compacting molding. Even if the temperature for heat-treatment is low, it is possible to secure a compression strength of 50 MPa.

The magnetic properties (residual magnetic flux density, coercive force), compression strength and the inter-face distance (regularly cyclic distance of the binder) of the amorphous oxide in the NdFeB group magnets using the precursors alkoxides) of various oxides as the binder are shown in Tables 1-1, 1-2, 1-3 and 1-4. The tables constitute one table that was simply divided into four parts for the purpose of edition. The precursors were alkoxysiloxanes or alkoxysilanes in formulae 1)-3) in embodiment 1. The Si atoms in the formulae 1)-3) in embodiment 1 may be substituted with other metal atoms.

TABLE 1-1

| | Br (T) | iHc (kOe) | Compression strength (MPa) | Average interface distance (nm) |
|---|---|---|---|---|
| $Ag_2O$ | 0.66 | 12.4 | 115 | 0.28-3.51 |
| $Ag_2O_2$ | 0.69 | 12.5 | 110 | 0.25-3.62 |
| $Al_2O_3$ | 0.70 | 12.6 | 121 | 0.28-2.85 |
| $Al_2TiO_5$ | 0.70 | 12.5 | 122 | 0.29-3.12 |
| $Bi_2O_3$ | 0.69 | 12.6 | 105 | 0.31-3.25 |

TABLE 1-2

| | Br (T) | iHc (kOe) | Compression strength (MPa) | Average interface distance (nm) |
|---|---|---|---|---|
| CaO | 0.70 | 12.6 | 110 | 0.36-3.97 |
| $CeO_2$ | 0.70 | 12.5 | 102 | 0.38-4.12 |
| CoO | 0.71 | 12.5 | 95 | 0.28-3.82 |
| $Co_3O_4$ | 0.71 | 12.8 | 96 | 0.24-3.91 |
| $CoFe_2O_4$ | 0.71 | 12.8 | 98 | 0.26-3.94 |
| $CoMoO_4$ | 0.69 | 12.5 | 102 | 0.24-3.75 |
| $CoTiO_3$ | 0.68 | 12.3 | 103 | 0.29-3.85 |
| $Cr_2O_3$ | 0.67 | 12.5 | 114 | 0.34-3.95 |
| $Cs_2O$ | 0.69 | 12.4 | 101 | 0.39-3.05 |
| $Cu_2O$ | 0.69 | 12.3 | 95 | 0.24-3.38 |
| CuO | 0.69 | 12.3 | 94 | 0.21-3.25 |
| $Fe_2O_3$ | 0.71 | 12.2 | 110 | 0.22-3.42 |
| $Fe_3O_4$ | 0.71 | 12.2 | 112 | 0.25-3.58 |
| FeO | 0.69 | 12.0 | 115 | 0.26-3.59 |
| $FeTiO_3$ | 0.69 | 12.3 | 106 | 0.28-3.97 |
| GeO | 0.68 | 12.4 | 121 | 0.24-3.23 |
| $GeO_2$ | 0.68 | 12.4 | 122 | 0.26-3.31 |

TABLE 1-2-continued

| | Br (T) | iHc (kOe) | Compression strength (MPa) | Average interface distance (nm) |
|---|---|---|---|---|
| $In_2O_3$ | 0.69 | 12.5 | 100 | 0.29-3.64 |
| $InFeO_3$ | 0.69 | 12.5 | 122 | 0.28-3.85 |
| MgO | 0.69 | 12.8 | 125 | 0.34-3.92 |
| $MgAl_2O_4$ | 0.71 | 12.6 | 110 | 0.31-3.85 |

TABLE 1-3

| | Br (T) | iHc (kOe) | Compression strength (MPa) | Average interface distance (nm) |
|---|---|---|---|---|
| $MgFe_2O_4$ | 0.72 | 12.5 | 115 | 0.24-3.86 |
| $MnO_2$ | 0.70 | 12.9 | 122 | 0.21-3.25 |
| $Mn_3O_4$ | 0.70 | 12.8 | 124 | 0.25-3.31 |
| $MnFe_2O_4$ | 0.71 | 12.5 | 121 | 0.26-3.38 |
| $MoO_2$ | 0.69 | 12.6 | 102 | 0.24-3.54 |
| $MoO_3$ | 0.69 | 12.5 | 105 | 0.23-3.61 |
| $Nb_2O_3$ | 0.68 | 12.6 | 121 | 0.29-3.75 |
| $NbO_2$ | 0.68 | 12.7 | 122 | 0.31-3.85 |
| NiO | 0.72 | 12.8 | 105 | 0.29-3.56 |
| $Ni_3O_4$ | 0.71 | 12.5 | 102 | 0.24-3.15 |
| $Sc_2O_3$ | 0.65 | 12.8 | 109 | 0.22-3.68 |
| SiO | 0.70 | 12.6 | 122 | 0.25-2.30 |
| $SiO_2$ | 0.71 | 12.5 | 120 | 0.25-2.21 |
| $SnO_2$ | 0.70 | 12.5 | 101 | 0.35-2.95 |
| SrO | 0.69 | 12.6 | 106 | 0.38-3.21 |
| $SrFe_2O_4$ | 0.72 | 12.9 | 124 | 0.31-3.54 |
| $SrFe_{12}O_{19}$ | 0.71 | 12.8 | 125 | 0.22-3.42 |
| $SrTiO_3$ | 0.70 | 12.4 | 128 | 0.29-3.64 |
| $Ta_2O_5$ | 0.69 | 12.5 | 124 | 0.22-3.59 |
| $TiO_2$ | 0.69 | 12.5 | 129 | 0.28-3.14 |
| $Ti_2O_3$ | 0.68 | 12.3 | 125 | 0.29-3.05 |

TABLE 1-4

| | Br (T) | iHc (kOe) | Compression strength (MPa) | Average interface distance (nm) |
|---|---|---|---|---|
| $V_2O_5$ | 0.67 | 12.6 | 105 | 0.27-2.95 |
| $V_2O_3$ | 0.69 | 12.5 | 115 | 0.25-2.84 |
| $V_2O_4$ | 0.68 | 12.4 | 118 | 0.22-2.79 |
| $Y_2O_3$ | 0.71 | 12.6 | 112 | 0.25-2.81 |
| $Yb_2O_3$ | 0.71 | 12.5 | 121 | 0.29-3.68 |
| ZnO | 0.68 | 12.5 | 125 | 0.28-3.25 |
| $ZnAl_2O_4$ | 0.69 | 12.4 | 124 | 0.24-3.31 |
| $ZrO_2$ | 0.68 | 12.5 | 125 | 0.29-3.54 |
| $ZrSiO_4$ | 0.69 | 12.5 | 109 | 0.21-3.62 |

The residual magnetic flux density was 0.6 T or more, and the coercive force was over 12 kOe. The values of the magnetic properties depend on magnetic properties of the magnetic powder used. In order to achieve the high residual magnetic flux density, magnetic powder of a high residual magnetic flux density is used to achieve the magnetic flux of 0.9 T. The compression strength of 100 MPa can be achieved. Though the inter-face distances were calculated the same, but it was observed that there were differences depending on the oxides.

Embodiment 4

Figure 2:
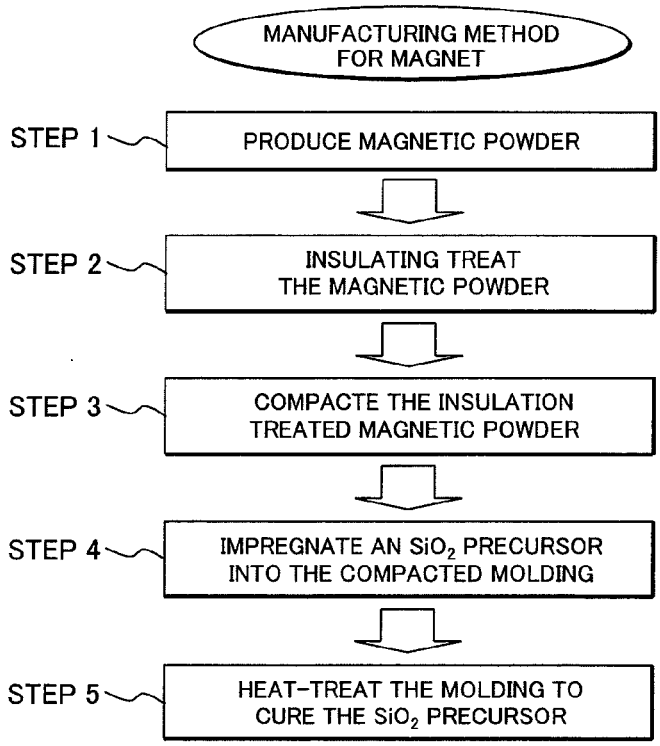
FIG. 2 is a flow chart for showing another method for manufacturing a magnet according to one embodiment of the present invention.

In this embodiment, the magnetic powder is coated with a fluoride compound and the coated magnetic powder is bonded with a binder. The process for manufacturing the magnet is illustrated in FIG. 2. This process differs from embodiments 1-3 in addition of step 2 (fluoride compound treatment, i.e. insulating treatment) before compressing the magnetic powder.

AS the magnetic powder, powder of ground NdFeB group strip same as that of Embodiment 1.

Treating solutions of fluorides of rare earth elements or alkaline earth elements for insulating treatment were prepared as follows.

(1) 4 grams of Lanthanum acetate or lanthanum nitrate, which has a high solubility in water was dissolved in 100 mL of water, and was completely dissolved by means of a stirrer or an ultrasonic stirrer.

(2) An equivalent of hydrofluoric acid diluted to a concentration of 10% was added to the above solution in a sufficient amount to produce $LaF_2$.

(3) The solution in which a precipitate of $LaF_3$ was stirred by means of the ultrasonic stirrer for more than one hour.

(4) After the solutions were subjected to centrifugation at a rotation speed of 4000-6000 r.p.m., supernatant was removed and approximately same amount of methanol was added.

(5) The methanol solution containing gelatinous $LaF_3$ was stirred to make complete suspension solution, the suspension was stirred by means of the ultrasonic stirrer for more than one hour.

(6) The step (4) and step (5) were repeated 3 to 10 times until acetate ions or nitrate ions are not detected.

(7) Finally, almost transparent $LaF_3$ sol was obtained. As a treating solution, a $LaF_3$ of 1 g/5 mL methanol solution was used.

Fluoride coatings of other rare earth element or alkaline earth metal can be formed in the same manner mentioned-above.

Formation of coating layers of the rare earth element fluorides or alkaline earth metal fluorides on the $Nd_2Fe_{14}B$ magnetic powder was carried out as follows.

(1) 15 mL of $NdF_3$ coating film forming treatment liquid (a concentration of $NdF_3$ was 1 g/10 mL) was 100 g of magnetic powder prepared by grinding $Nd_2Fe_{14}B$ foil, and the mixture was mixed until the entire of the magnetic powder for the rare earth element magnet was wetted.

(2) The rare earth element magnet powder, which has been treated with the $NdF_3$ coating film forming liquid, was subjected to methanol removal under a reduced pressure of 2-5 torr.

(3) The rare earth element magnet powder from which the solvent has been removed at the step (2) was transferred to a quartz boat. A heat treatment of the magnet powder was carried out under a reduced pressure of $1\times10^{-5}$ torr at 200° C. for 30 minutes, and at 700° C. for 30 minutes.

(4) The magnetic powder treated at (3) was transferred to a container made of $Al_2O_3$ (manufactured by Riken Electronics) with a cover. The powder was heat treated under a reduced pressure of $1\times10^{-5}$ torr at 700° C. for 30 minutes.

25 mL of a precursor of $SiO_2$ bonding agent was $CH_3$—$(Si(CH_3O—O)_2—O)_m$—$CH_3$, wherein m is 3 to 5 and an average value was 4, 4.8 mL of water, 75 mL of dehydrated methyl alcohol, 0.05 mL of dibutyltin (IV) dilaurate were mixed and the mixture was left for two nights and two days at 25° C.

(1) The magnetic powder of $Nd_2Fe_{14}B$, which was coated with the rare earth element fluorides or alkaline earth metal fluorides, was filled in a mold, and was compacted under a pressure of 16 t/cm$^2$ to produce compacted moldings each having a vertical of 10 mm, a width of 10 mm, and a thickness of 5 mm for measuring magnetic properties and compacted moldings each having a vertical of 15 mm, a width of 10 mm, and a thickness of 2 mm for measuring mechanical strength.

(2) The compacted moldings prepared in the step (1) were placed in vats in a manner that the pressing direction is horizontal. The compacted moldings were left for two nights and two days at 25° C. Precursor solutions of $SiO_2$ binder were charged at a rising rate of level at 1 mm/min in the vats until the liquid level was 5 cm above the top surface of the compacted moldings.

(3) The vats where the compacted moldings were placed and the precursor solutions were charged were set in a vacuum chamber to evacuate gradually to about 80 MPa. The compacted moldings were left until bubbles were not observed from the surfaces thereof.

(4) The inner pressure of the vacuum chamber wherein the vats containing the compacted moldings and the precursor solutions were set was recovered gradually to the atmospheric pressure, and the compacted moldings were taken out from the precursor solution in the vats.

(5) The compacted moldings prepared in the step (4) were set in a vacuum dryer and drying treatment was conducted under a pressure of 1-3 Pa at a temperature of 150 to 700° C. Since the magnetic powder of $Nd_2Fe_{14}B$ is coated with fluoride, oxidation of the magnetic powder is prevented even if the vacuum heat treatment is conducted at a temperature of 300° C. or higher.

(6) The compacted moldings having the size of 10×10×5 mm were subjected to measurement of specific resistance.

(7) The compacted moldings that have been subjected to the measurement of specific resistance were subjected to measurement of magnetic properties by applying a pulse magnetic field of 30 kOe or higher thereto.

(8) The compacted moldings prepared in the step (5) having the size of 15×10×2 mm were subjected to a mechanical bending test. The bending strength of the compacted moldings was evaluated by a three point bending test whose fulcrum distance was 12 mm.

The magnetic properties of the compacted moldings prepared in the step (5) having the size of 10×10×5 mm were 20 to 30% better than those of the resin bonded magnet. The demagnetization curve measured at 20° C. showed that residual magnetic flux density and coercive force of both the compacted moldings with impregnation and compacted moldings without impregnation were almost the same.

The thermal demagnetization rate of the compacted molding with impregnation that was kept at 200° C. in air for one hour was 3.0%, which is smaller than that of the compacted molding without impregnation. The compacted molding showed thermal demagnetization of 5%. Further, the irreversible thermal demagnetization rate of the compacted molding with impregnation, which was kept in air at 200° C. for one hour, showed 1% or less, which is smaller than that (3%) of compacted molding without impregnation. This is because the $SiO_2$ prevents oxidation of magnetic powder.

Besides $SiO_2$, various oxides can be used as precursor for impregnation into the compacted moldings. The precursors are organic compounds such as alkoxides of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and/or $ZrSiO_4$.

In the magnets having coating of fluorides of rare earth elements or alkaline earth metals, the coating functions not only an insulating film, but also contributes improvement of coercive force when $TdF_3$ and $DyF_3$ or $PrF_3$, though $PrF_3$ having a little effect, is used as the coating material.

From the above results, the rare earth element bond magnets prepared by cold compacting molding and impregnating the oxide precursor are superior in magnetic properties by 20%, and reduce the irreversible thermal demagnetization by half or less, and improve reliability, compared with conventional resin bond rare earth magnets. Further, When $TbF_3$ and $DyF_3$ or oxy-fluorine compounds of Tb or Dy is coated on the magnetic powder, magnetic properties can be greatly improved. Since the rare earth elements in the fluorides or oxy-fluorine compounds that are coated on the surface of the magnetic powder particles diffuse into grain boundaries when the magnets are heated. As a result, the coercive force increases and the magnets hard to lower the demagnetization. The magnets can be used at 150 to 200° C.

Embodiment 5

In this embodiment, the magnetic powder NdFeB similar to that used in the embodiment 1 was used.

A coating of fluoride of rare earth element or of alkaline earth metals was coated on $Nd_2Fe_{14}B$ powder in the following manner.

(1) 1-30 mL of a solution for forming a $PrF_3$ coating was added to 100 g of magnetic powder prepared by grinding strip of $Nd_2Fe_{14}B$ alloy, and the mixture was mixed until the magnetic powder was wet. The solution for forming the $PrF_3$ coating was a semi-transparent sol solution having a concentration of 0.1 g/10 mL.

(2) The magnetic powder to which the $PrF_3$ coating was formed was subjected to methanol removal under a reduced pressure at 2-5 torr.

(3) The magnetic powder from which the methanol solvent was removed in the step (2) was transferred to a quartz boat, and was heat treated under a pressure of $11\times10^{-5}$ torr at 200° C. for 30 minutes and 400° C. for 30 minutes.

(4) The heat-treated magnetic powder in the step (3) was charged in a container made of $Al_2O_3$ (manufactured by Riken Electronics) to conduct heat-treatment under a pressure of $1\times10^{-5}$ torr at 700° C. for 30 minutes.

As the precursor solution for the $SiO_2$ binder, $CH_3O$—$(Si(CH_3O)_2$—$O)_mCH_3$ (M is 3-5, an average number is 4) was used. 25 mL of the precursor, 4.8 mL of water, 75 mL of dehydrated methyl alcohol and 0.05 mL of dibutyltin (IV) dilaurate were mixed and the mixture was left for two nights and two days.

(1) The $Nd_2Fe_{14}B$ powder having the $PrF_3$ coating was charged in a mold, and compacted under a pressure of 16 t/cm$^2$ to produce compacted moldings each having a vertical of 10 mm, a width of 10 mm and a thickness of 5 mm and compacted moldings each having a vertical of 15 mm, a width of 10 mm and a thickness of 2 mm.

(2) the moldings prepared in the step (1) were placed in vats in a manner that the pressing direction became horizontal, and were left for two nights and two days at 25° C. The $SiO_2$ precursor solution was charged in the vats at a rising rate of level at 1 mm/min until the level of the solution was 5 mm above the top surface of the moldings.

(3) The vats where the moldings used in the step (2) and filled with the precursor solution were set in a vacuum container, and the container was gradually evacuated to 80 Pa until bubbles were not observed from the surface of the moldings.

(4) The vacuum chamber where the vats filled with the precursor solution and the moldings were placed was gradually revered to the atmospheric pressure, and the moldings were taken out from the vats.

The molding impregnated with the precursor solution in the sep (4) were set in a vacuum dryer, and the moldings were subjected to vacuum heat-treatment under a pressure of 1-3 Pa at 150-700° C.

(6) The moldings prepared in the step (5) each having a vertical of 10 mm, a width of 10 mm and a thickness of 5 mm was subjected to measurement of specific resistance by a four probe method.

(7) The moldings that have been subjected to specific resistance measurement were subjected to measurement of magnetic properties by applying pulse magnetic field of 30 kOe.

(8) The moldings prepared un the step (5) each having a vertical of 15 mm, a width of 10 mm and a thickness of 2 mm were subjected to the mechanical bending test. The bending strength was measured by the three point bending test wherein a distance between fulcrums was 12 mm.

The magnetic properties of the moldings prepared in the step (5) each having a vertical of 10 mm, a width of 10 mm and a thickness of 5 mm showed the residual magnetic flux density of 20 to 30% higher than that of resin bond magnet (Comparative 1), and showed that the residual magnetic flux density and coercive force of demagnetization curves at 20° C. before the impregnation and after impregnation coincide with each other. Further, the thermal demagnetization rate after keeping them in air at 200° C. for one hour, the $SiO_2$ bond magnet showed 3.0%, which is smaller than that (5%) of magnet without impregnation.

The irreversible thermal demagnetization after keeping them at 200° C. for one hour, the molding with $SiO_2$ impregnation showed 1% or less, which is smaller than that (about 3%) of the molding without $SiO_2$ impregnation. This is because the $SiO_2$ prevents deterioration of magnet by oxidation of the magnetic powder.

The $PrF_3$ coating on the magnetic powder particles functions not only as an insulating layer, but also as a substance for improving a coercive force of the magnet.

The bending strength of the moldings prepared in the step (5) each having a vertical of 15 mm, a width of 10 mm and a thickness of 2 mm was 2 MPa or less in case of no $SiO_2$ impregnation. However, the moldings after $SiO_2$ impregnation showed 100 MPa or higher.

The magnets of the embodiment showed a specific resistance about 100 times or more the resistance of the sintered type rare earth element magnets, and almost the same resistance as that of the compacted magnets. Accordingly, eddy current loss of the magnets of the embodiments is small.

From the above results of the embodiments, it is apparent that the rare earth element magnets showed the residual magnetic flux density 20% larger than that of the conventional resin bond rare earth element magnets and showed the bending strength 2 to 3 times that of the conventional resin bond magnets. Further, the irreversible thermal demagnetization rate of the embodiments can be reduced to half or less that of the conventional resin bond magnets. It is possible to improve reliability of the magnets. If $PrF_3$ or Oxy-fluorine compound of Pr is applied onto the magnetic powder particles, magnetic properties of the magnets can be greatly observed. Particularly, if $PrF_3$ is coated on the magnetic powder, magnetic properties, bending strength and reliability are improved. That is, the magnets according to the embodiments exhibit well balance properties.

The magnets according to the present invention may be applied to various motors for electric appliances, industrial appliances, and for permanent magnet motors for use in automobiles.

What is claimed is:

1. A magnet comprising magnetic powder containing at least one rare earth metal element, the magnetic powder being composed of particles each constituted by fine crystals having an average size of 10 to 100 nm, and an amorphous binder for binding the magnetic powder, wherein an inter-face distance of the binder determined by diffraction analysis is 0.25 to 2.94 nm, the magnet being compact-molded.

2. The magnet according to claim 1, wherein the amorphous binder contains at least one selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$.

3. The magnet according to claim 1, wherein the magnetic powder is of NdFeB group alloy.

4. The magnet according to claim 1, further comprising an insulating film having a lamellar structure of a fluoride of a rare earth element formed between the magnetic powder and the amorphous binder.

5. A magnet comprising magnetic powder composed of particles each being constituted by fine crystals containing at least one rare earth element, an amorphous binder for bonding the magnetic powder, and insulating films present between the magnetic powder and the amorphous binder, wherein an inter-face distance of the binder determined by diffraction analysis is 0.25 to 2.94 nm, the magnet being compact-molded.

6. The magnet according to claim 5, wherein the insulating film is of a fluoride of a rare earth element.

7. The magnet according to claim 5, wherein the amorphous binder contains at least one selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$.

8. The magnet according to claim 5, wherein the magnetic powder is of NdFeB group alloy.

9. The magnet according to claim 5, wherein the insulating film has a lamellar structure of a fluoride of a rare earth element.

10. A magnet comprising magnetic powder composed of particles each being constituted by fine crystals having an average size of 10 to 100 nm, and an amorphous bonding material containing at least one metal oxide selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$, and $ZrSiO_4$.

11. A magnet comprising magnetic powder composed of particles each being constituted by fine crystals having an average size of 10 to 100 nm, and an amorphous bonding material containing at least one metal oxide selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$; ZnO, $ZnAl_2O_4$, $ZrO_2$, and $ZrSiO_4$.

12. A method of manufacturing a magnet comprising:

compacting magnetic powder containing at least one rare earth element under pressure in a mold;

impregnating the compacted magnetic powder molding with a precursor solution containing a precursor of an amorphous binder; and heat-treating the compacted magnetic molding impregnated with the precursor thereby to form fine crystals having a mean size of 10 to 100 nm and to form an inter-face distance of the binder determined by diffraction analysis to the binder in the compacted magnetic powder molding, the distance being 0.25 to 2.94 nm.

13. The method of manufacturing the magnet according to claim 12, wherein the amorphous binder is at least one selected from the group consisting of AgO, $Ag_2O$, $Ag_2O_3$, $Al_2O_3$, $Al_2TiO_5$, $Bi_2O_3$, CaO, $CeO_2$, CoO, $Co_3O_4$, $CoFe_2O_4$, $CoTiO_3$, $Cr_2O_3$, $Cs_2O$, $Cu_2O$, $Fe_2O_3$, $Fe_3O_4$, FeO, $FeTiO_3$, GeO, $GeO_2$, $In_2O_3$, $InFeO_3$, MgO, $MgAl_2O_4$, $MgFe_2O_4$, $MnO_2$, $Mn_3O_4$, $MnFe_2O_4$, $MoO_2$, $MoO_3$, $Nb_2O_5$, $NbO_2$, NiO, $Ni_3O_4$, $Sc_2O_3$, SiO, $SiO_2$, $SnO_2$, SrO, $SrFe_2O_4$, $SrFe_{12}O_{19}$, $SrTiO_3$, $Ta_2O_5$, $TiO_2$, $Ti_2O_3$, $V_2O_5$, $V_2O_3$, $Yb_2O_3$, ZnO, $ZnAl_2O_4$, $ZrO_2$ and $ZrSiO_4$.

14. The method according to claim 12, which further comprising treating the magnetic powder with a solution containing a fluoride of a rare earth element to form an insulating film on the magnetic powder, prior to compacting the magnetic powder.

15. The method according to claim 12, wherein the heat-treating of the compacted molding is carried out at 200 to 700° C.

16. The method according to claim 12, further comprising forming an insulating film having a lamellar structure of a fluoride of a rare earth element between the magnetic powder and the amorphous binder.

17. A method of manufacturing a magnet comprising:

compacting magnetic powder containing at least one rare earth element under pressure in a mold;

impregnating the compacted magnetic powder molding with a precursor solution containing a precursor of an oxide for a binder; and heat-treating the compacted magnetic molding impregnated with the precursor thereby to form fine crystals having a mean size of 10 to 100 nm and to form an inter-face distance of the binder determined by diffraction analysis to the binder in the compacted magnetic powder molding.

* * * * *